US009484169B2

(12) United States Patent
Gentsch et al.

(10) Patent No.: US 9,484,169 B2
(45) Date of Patent: Nov. 1, 2016

(54) VACUUM INTERRUPTER ARRANGEMENT FOR A MEDIUM VOLTAGE CIRCUIT BREAKER WITH CUP-SHAPED TMF-CONTACTS

(71) Applicant: ABB Technology AG, Zurich (CH)

(72) Inventors: Dietmar Gentsch, Ratingen (DE); Kai Hencken, Loerrach (DE); Tarek Lamara, Confignon (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/707,486

(22) Filed: May 8, 2015

(65) Prior Publication Data

US 2015/0248978 A1 Sep. 3, 2015

Related U.S. Application Data

(63) Continuation of application No. PCT/EP2013/003335, filed on Nov. 6, 2013.

(30) Foreign Application Priority Data

Nov. 8, 2012 (EP) ..... 12007608

(51) Int. Cl.
*H01H 33/664* (2006.01)

(52) U.S. Cl.
CPC ..... *H01H 33/6642* (2013.01)

(58) Field of Classification Search
CPC . H01H 33/6606; H01H 33/66; H01H 33/664
See application file for complete search history.

(56) References Cited

U.S. PATENT DOCUMENTS 4,129,760 A * 12/1978 Okutomi ..... H01H 1/0203 218/132
4,617,434 A * 10/1986 Zuckler ..... H01H 33/6644 218/127

(Continued)

FOREIGN PATENT DOCUMENTS

DE 30 35 875 A1 5/1982
DE 34 34 417 A1 3/1986

(Continued)

OTHER PUBLICATIONS

International Search Report (PCT/ISA/210) mailed on Jan. 9, 2014, by the European Patent Office as the International Searching Authority for International Application No. PCT/EP2013/003335.

(Continued)

*Primary Examiner* — Truc Nguyen
(74) *Attorney, Agent, or Firm* — Taft Stettinius & Hollister LLP

(57) ABSTRACT

An exemplary vacuum interrupter arrangement for a medium voltage circuit breaker includes a vacuum housing within which a pair of electrical contacts are coaxially arranged and concentrically surrounded by the cylindrical shaped vacuum housing. The electrical contacts are formed as a type of TMF-contacts, each having a slotted cup-shaped contact part which is attached to the distal end of a contact shaft and which is covered by a contact ring disposed on a rim of the cup-shaped contact part, wherein each cup-shaped contact part is provided with a vertical inward bending towards the contact ring. The outer diameter of the bottom section of the cup-shaped contact part is larger than the outer diameter of its rim section, in order to alter the Lorentz force to a respective inward direction.

14 Claims, 3 Drawing Sheets

(56) References Cited

U.S. PATENT DOCUMENTS

| | | | | |
|---|---|---|---|---|
| 4,999,463 | A * | 3/1991 | Yin | H01H 33/6643 218/128 |
| 5,438,174 | A * | 8/1995 | Slade | H01H 33/6644 218/118 |
| 6,163,002 | A * | 12/2000 | Ahn, II | H01H 33/6643 218/123 |
| 7,250,584 | B2 * | 7/2007 | Asmus | H01H 33/6644 218/123 |
| 9,006,600 | B2 * | 4/2015 | Leusenkamp | H01H 9/52 218/118 |
| 2004/0050819 | A1 * | 3/2004 | Matsui | H01H 33/6642 218/123 |
| 2004/0124179 | A1 * | 7/2004 | Nishijima | H01H 33/6642 218/123 |
| 2008/0023445 | A1 * | 1/2008 | Haas | H01H 33/6642 218/141 |
| 2008/0041825 | A1 * | 2/2008 | Stoving | H01H 33/66207 218/120 |
| 2014/0291293 | A1 * | 10/2014 | Gentsch | H01H 33/66207 218/139 |

FOREIGN PATENT DOCUMENTS

| | | | |
|---|---|---|---|
| GB | 1095638 | A | 12/1967 |
| JP | 2010-267442 | A | 11/2010 |
| WO | WO 2006/002560 | A1 | 1/2006 |

OTHER PUBLICATIONS

Written Opinion (PCT/ISA/237) mailed on Jan. 9, 2014, by the European Patent Office as the International Searching Authority for International Application No. PCT/EP2013/003335.

Search Report dated Apr. 8, 2013, by the European Patent Office for Application No. 12007608.

* cited by examiner

VACUUM INTERRUPTER ARRANGEMENT FOR A MEDIUM VOLTAGE CIRCUIT BREAKER WITH CUP-SHAPED TMF-CONTACTS

RELATED APPLICATION(S)

This application claims priority under 35 U.S.C. §120 to International application PCT/EP2013/003335 filed on Nov. 6, 2013, designating the U.S., and claiming priority to European application 12007608.8. The content of each prior application is hereby incorporated by reference in its entirety.

FIELD

The disclosure relates to a vacuum interrupter arrangement for a medium voltage circuit breaker including a vacuum housing within which a pair of electrical contacts can be coaxially arranged and concentrically surrounded by the cylindrical shaped vacuum housing.

BACKGROUND INFORMATION

Known vacuum interrupters can be used in medium-voltage circuit breakers for high current interruption at occasional short circuit current fault, as well as for load current switching. For high current interruption, the vacuum arc becomes constricted, and releases very high thermal energy onto the contacts. If not prevented, the arc energy yields a strong local overheating of the contacts, which leads to severe contact erosion and high metal vapor density after zero current, which makes the current interruption very challenging or unsuccessful.

In order to achieve high current interruption performance, the heat arising from the vacuum arc should be managed by spreading out the energy over the whole contacts surface. There can be currently two standard methods for the vacuum arc control in a way to distribute the heat flow over an area of the contacts as large as possible.

The vacuum arc control can be achieved by generating either a transverse magnetic field (TMF) in order to drive the constricted arc in rotating motion under the effect of Lorentz forces, or an axial magnetic field (AMF) to confine the charged particles around the magnetic flux lines and to stabilize the arc by making it diffuse over the whole contact surface with low current density.

SUMMARY

An exemplary vacuum interrupter arrangement for a medium voltage circuit breaker is disclosed, comprising: a vacuum housing that is cylindrically shaped within which a pair of electrical contacts can be coaxially arranged and concentrically surrounded by the vacuum housing, wherein the electrical contacts can be formed as a type of TMF-contact, each having a slotted cup-shaped contact part which is attached to a distal end of a contact shaft and which is covered by a contact ring disposed on a rim of the cup-shaped contact part, wherein each cup-shaped contact part is provided with a vertical inward bending towards the contact ring, wherein an outer diameter of a bottom section of the cup-shaped contact part is larger than an outer diameter of the rim of the cup-shaped contact part in order to alter a Lorentz force on a constricted columnar arc to a respective inward direction.

BRIEF DESCRIPTION OF THE DRAWINGS

The foregoing and other aspects of the disclosure will become apparent following the detailed description of the disclosure when considered in conjunction with the enclosed drawings. in which.

DETAILED DESCRIPTION

Figure 1:
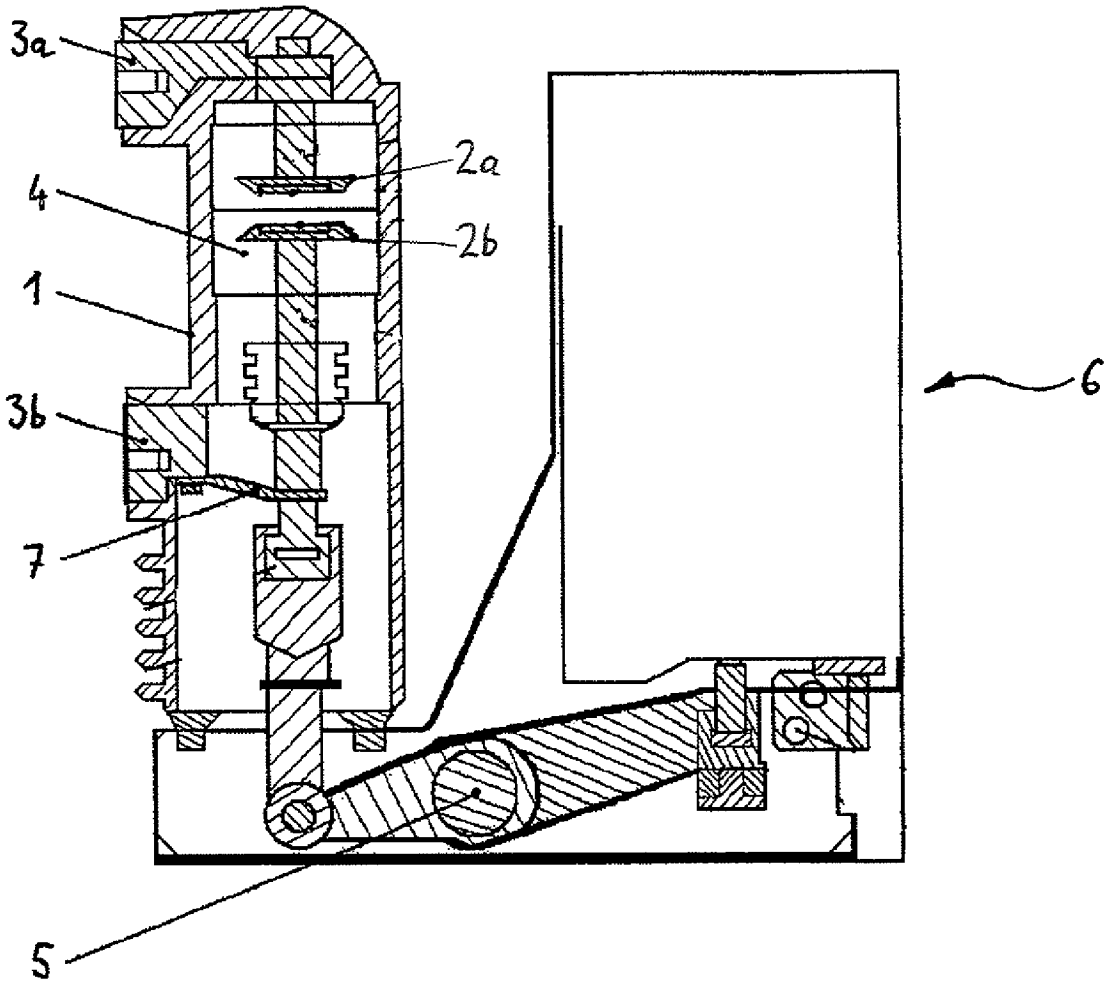
FIG. 1 is a longitudinal section through a medium-voltage circuit breaker having a vacuum interrupter arrangement in accordance with an exemplary embodiment of the present disclosure.

The present disclosure is directed to a vacuum interrupter arrangement including cup-shaped electrical contacts which can be formed as types of TMF-contacts, each including a slotted cup-shaped contact part which is attached to the distal end of a contact shaft and which is covered by a contact ring disposed on the rim of the cup-shaped contact part. Moreover, the disclosure is also applicable to double-TMF contact systems with an outer cup-shape contact.

The document WO 2006/002 560A1 discloses such a double-TMF contact system including a pair of corresponding electrical contacts which can be coaxially arranged inside a cylindrical shaped vacuum housing. Each electrical contact includes an outer contact piece which is electrically connected in parallel and mounted closely adjacent to an inner contact piece. Both contact pieces can be coaxially disposed in relation to each other. The outer contact piece is pot-shaped for accommodating the inner contact piece, which is substantially discoid and provided with spiral slits. Due to that special electrical contact arrangement, during interruption the resulting electric arc can commute completely or partially from the pair of inner contact pieces to the pair of outer contact pieces.

In the case of a known cup-shape TMF contact system, the arc will be formed between the rings of the pair of contact. For example, during the high current arcing phase, and at large contacts gap-distance the constricted arc roots can be attached to the external edges of the contact pieces. With this scenario, from certain contacts separation distance, such as greater than 8 mm, the arc undergoes an outward bending or turns into arc jet mode. This arc jet mode is also observed with other standard spiral-type contacts. Hence, the contacts-shield distance is usually increased to avoid the direct arc-shield interaction. Ideally, the arc should rotate and remain between the rings of the cup-shaped contact pieces to avoid its eventual interaction with the shield and to prevent the metal melt diffusion to the lateral slits of the cup-shaped contact.

Exemplary embodiments of the present disclosure improve the cup-shape contacts geometry for a better arc control in cup-type TMF vacuum interrupter arrangements.

According to an exemplary embodiment described herein, each cup-shaped contact part is provided with a vertical inward bending towards the contact ring, wherein the outer diameter of the bottom section of the cup-shaped contact part is larger than the outer diameter of the rim section, in order to alter the Lorentz force to a respective inward direction.

The solution according to exemplary embodiments of the present disclosure prevent the cup-type electrical contacts and the shield from damages. This will result in increased reliability and current interruption performance over the vacuum interrupter lifetime. The geometry proposed in view of the present disclosure can be also used for outer contact pieces of a double-TMF contact system as well as for known single cup-shaped TMF-contacts.

According to the results of scientific tests the outward bending of the constricted arc, and its eventual transformation to arc jet mode, is initially a result of the TMF driving forces, namely the Lorentz forces. The Lorentz forces profile of the outer cup-shaped contacts is usually pointing outwardly to some degree. Hence, the arc which is rotating under the Lorentz forces effect is also pushed outwardly under the action of these Lorentz forces themselves.

To hinder this effect one should change the contacts geometry to alter the Lorentz forces profile to an inward direction, or at least to a line with the velocity vector of the rotating arc. According to an exemplary embodiment of the present disclosure, this alteration can be achieved by changing the current path in the vertical direction in the contacts, as the magnetic field direction is then changed in such a way as to make the Lorentz forces oriented more inwards.

To get the expected effect on Lorentz forces orientation it is proposed to design the outer cup-shaped contact with a vertical inward bending towards the contact surface ring. The effect of this bending is to keep the rotating arc between the outer contacts ring, prevent its (rotating arc) eventual interaction with the shield, and reduce the melt diffusion to the slits. Another positive consequence of that special design is the reduction of the distance between the shield and the contacts. An over-dimensioning can then be avoided leading to a more compact design and material saving.

In principal, the direction of the Lorentz forces is strongly influenced by the outer-cup bending and an inward bending could change significantly the Lorentz force direction in the desired way. From this point of view, the inward bending according to exemplary embodiments described herein gives the best solution for Lorentz forces orientation to keep the arc between the outer rings and reduce the probability of its interaction with the shield.

There can be several special embodiments of the disclosure which fulfill the conditions of TMF Lorentz force orientation to the inward direction. Exemplary embodiments of the contacts design which can be considered in any TMF cup-type contacts design should be described therein after:

According to an exemplary embodiment the vertical inward bending on the cup-shaped contact part is provided by a flat flange section of the cup-shaped contact part which is inwardly bent. The said flat flange section can have a constant wall thickness. The contact ring is disposed on the rim of the cup-shaped contact part which is formed by the distal end of the flat flange section.

In view of another exemplary embodiment, the cup-shaped contact part is provided with a concave groove disposed in the inner wall of the flange section.

According to yet another exemplary embodiment, the cup-shaped contact part is provided with a concave groove disposed in the outer wall of the flange section in the area of its rim. Additionally, it is possible to dispose a further concave groove in the inner wall of the flange section, for example, in the area of the bottom section of the cup-shaped contact part.

Although the foregoing described exemplary embodiments can be directed to single cup-type TMF-contacts, the present disclosure is also applicable to double-TMF contact systems, including a discoid inner contact piece which is surrounded by an outer cup-shaped contact piece. At these contact systems a helical slotted outer cup-shaped contact piece can correspond with a spiral slotted inner contact piece.

FIG. 1 is a longitudinal section through a medium-voltage circuit breaker having a vacuum interrupter arrangement in accordance with an exemplary embodiment of the present disclosure. The medium voltage circuit breaker as shown in FIG. 1 includes an insulating pole part 1 of a vacuum interrupter within which a pair of electrical contacts 2*a*, 2*b* is coaxially arranged. A stationary electrical contact 2*a* corresponds with a moveable electrical contact 2*b*. Both electrical contacts 2*a* and 2*b* have corresponding outer electrical connectors 3*a* and 3*b* respectively and they form an electrical switch for electrical power interruption inside a vacuum housing 4 of the pole part 1. The moveable electrical contact 2*b* is moveable between the closed and the opened position via a jackshaft 5. The jackshaft 5 internally couples the mechanical energy of an electromagnetic actuator 6 to the moving electrical contact 2*b* inside the insulating part 1. In order to ensure an electrical connection between the moveable electrical contact 2*b*, which is moveably attached to the electro-magnetic actuator 6, a flexible conductor 7 is provided between said moveable electrical contact 2*b* and the outer electrical connector 3*b*.

Figure 2:
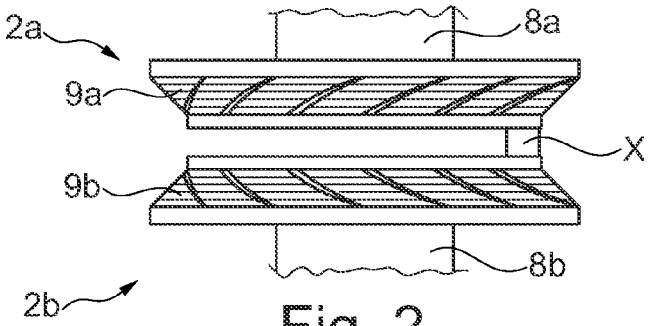
FIG. 2 is a schematic side view of a part of corresponding electrical contacts with a vacuum arc in-between in accordance with an exemplary embodiment of the present disclosure.

FIG. 2 is a schematic side view of a part of corresponding electrical contacts with a vacuum arc in-between in accordance with an exemplary embodiment of the present disclosure. Ash shown in FIG. 2, each electrical contact 2*a* and 2*b* can have a slotted cup-shaped design forming a TMF-contact. Each contact part 9*a* and 9*b* is attached to the distal end of a contact shaft 8*a* or 8*b* respectively. During current interruption and arc zone X is disposed between both cup-shaped contact parts 9*a* and 9*b* of the electrical contacts 2*a* and 2*b*.

Figure 3:
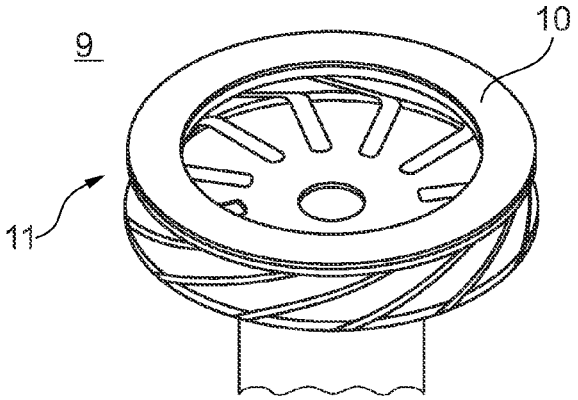
FIG. 3 is a perspective view of the electrical contact as shown in FIG. 2 in accordance with an exemplary embodiment of the present disclosure.

FIG. 3 is a perspective view of the electrical contact as shown in FIG. 2 in accordance with an exemplary embodiment of the present disclosure. As shown in FIG. 3, the cup-shaped contact part 9*a* (for example) is covered by a contact ring 10 disposed on the rim 11 of the slotted cup-shaped contact part 9.

Figure 4:
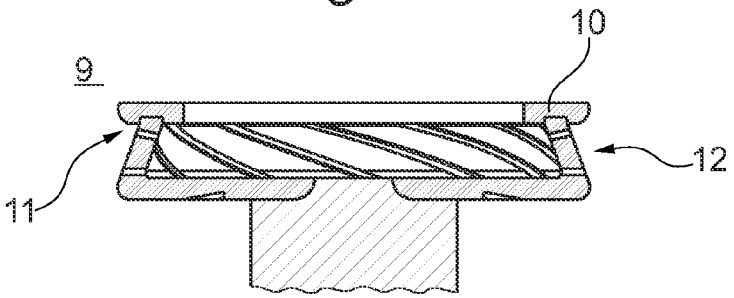
FIG. 4 is a sectional side view of a first cup-shaped contact part in accordance with an exemplary embodiment of the present disclosure.

FIG. 4 is a sectional side view of a first cup-shaped contact part in accordance with an exemplary embodiment of the present disclosure. As shown in FIG. 4 the exemplary cup-shaped contact part 9 has a vertical invert bent flat flange section 12, which is directed towards the contact ring 10. The outer diameter of the bottom section of the cup-shaped contact part 9 is larger than the outer diameter of the rim section 11 in order to alter the Lorentz force to a respective invert direction.

Figure 5:
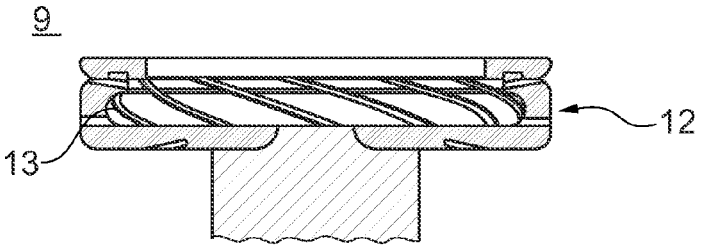
FIG. 5 is a sectional side view of a second cup-shaped contact part in accordance with an exemplary embodiment of the present disclosure.

FIG. 5 is a sectional side view of a second cup-shaped contact part in accordance with an exemplary embodiment of the present disclosure. As shown in FIG. 5 the exemplary cup-shaped contact part 9' has a vertical invert bending with a concave groove 13, which is disposed in the inner wall of the flange section 12 of the cup-shaped contact part 9'.

Figure 6:
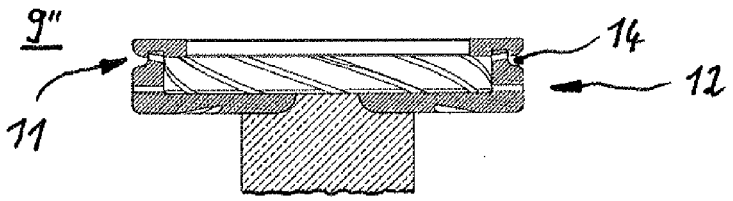
FIG. 6 is a sectional side view of a third cup-shaped contact part in accordance with an exemplary embodiment of the present disclosure.

FIG. 6 is a sectional side view of a third cup-shaped contact part in accordance with an exemplary embodiment of the present disclosure. As shown in FIG. 6, an exemplary cup-shaped contact part 9" has a vertical invert bending that is provided with a concave groove 14 which is disposed in the outer wall of the flange section 12 in the area of its rim 11.

Figure 7:
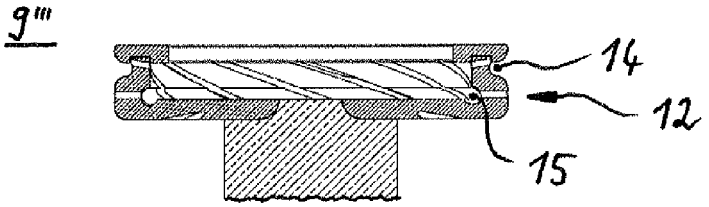
FIG. 7 is a sectional side view of a fourth cup-shaped contact part in accordance with an exemplary embodiment of the present disclosure.

FIG. 7 is a sectional side view of a fourth cup-shaped contact part in accordance with an exemplary embodiment of the present disclosure. As shown in FIG. 7, an additional concave groove 15 is disposed in the inner wall of the flange section 12 in the bottom area of the cup-shaped contact part 9". A further concave groove 14 is disposed in the outer wall of the flange section 12 as described in connection with the foregoing embodiment.

Figure 8:
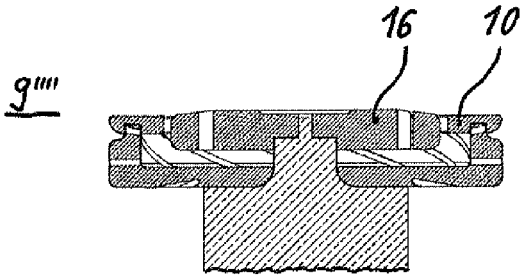
FIG. 8 is a sectional side view of a fifth cup-shaped contact part in accordance with an exemplary embodiment of the present disclosure.

FIG. 8 is a sectional side view of a fifth cup-shaped contact part in accordance with an exemplary embodiment of the present disclosure. As shown in FIG. 8 a double TMF contact system includes a discoid inner contact part 16 which is surrounded by an outer cup-shaped and slotted contact part 9. The contact ring 10 can have the same outer diameter like the bottom section of the cup-shaped contact part 9 which is also provided at the foregoing described embodiments.

Figure 9:
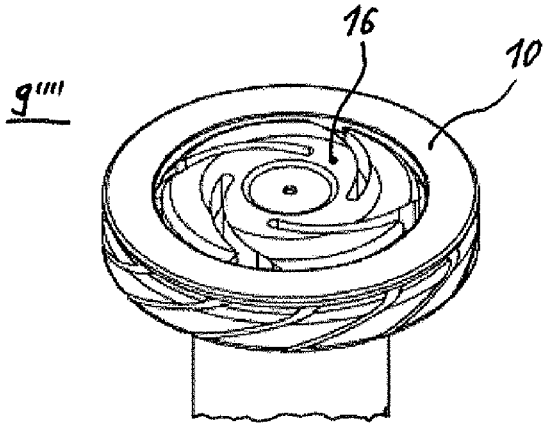
FIG. 9 is a perspective view of the contact part as shown in FIG. 8 in accordance with an exemplary embodiment of the present disclosure.

FIG. 9 is a perspective view of the contact part as shown in FIG. 8 in accordance with an exemplary embodiment of the present disclosure. As shown in FIG. 9 the discoid inner contact part 16 is also helical slotted and inserted into the surrounding cup-shaped contact part 9.

The high current vacuum arc behavior in a vacuum interrupter can depend on a number of different factors, such as on the driving forces that can be moving the arc along. In the case of a (transverse) magnetic field, the main driving force is the foregoing mentioned Lorentz force coming from the combined effect of "induced magnetic field" $B_{TMF}$ and the current flowing through the arc. If the B-field is rather homogenous, the total force on the arc is given by $$F_{TMF}=l\cdot I\cdot B_{TMF}=K\cdot l\cdot I^2 \tag{1}$$

Where l is the gap distance and I the total current flowing through the arc. For $B_{TMF}$ different values can be possible, which also depend on details of the geometry, such as contact shape and gap distance. The proportionality factor K depends on the strength of the magnetic flux density as a function of the current.

In the case of a magnetically driven arc, mostly a single running columnar arc for gap distances above 5 mm is existing, which of course can also interact with the shield.

For example, at high currents the dominant arc mode is no longer the columnar arc, but "anode and cathode jets vacuum arc". This arc can have the tendency to move to the contact edges and form two jets into the region outside.

The question is how these transitions to the arc modes at the contact edges appear. According to known implementations, the appearance of the two-jet mode is assumed to be due to the presence of the kink-instability in a plasma column. This is one of a number of instabilities in a plasma column.

But the kink instability occurs, if the plasma column is already distorted slightly sideways. Due to the property of the magnetic flux density being source less, a bending of a plasma column leads to an increase of the magnetic field on the inside of the bend. This leads to an increase in the magnetic force "on the inside of the kink" towards the bend direction, forcing the bent column to be bent even more.

If a columnar arc is inside between two TMF contacts, its motion to be due dominantly by the (TMF) Lorentz force effect is expected. Therefore, a rotational motion of the arc as long as it is inside the contacts can be expected. This might lead initially to a slight arc bending, but only at the contacts edge the instability can fully develop itself and the arc is blown outside.

The TMF forces "push" the vacuum arc to the edge, eventually blowing it to the outside. From this event, on the other hand, one can compare the relative importance of the driving force from the TMF magnetic field and the force driving the arc instability. This estimate can be used to get the radius of curvature R an arc should have in order to realize a kink-instability force, which is as large as the TMF force:

The kink-instability force $F_{kink}$can be expressed in simplified way as follows:

$$F_{kink} \approx \mu_0 \frac{l\cdot I^2}{2\pi R} \tag{2}$$

Comparing this with the force by the TMF magnetic field from Eq. (1), the critical radius of curvature is:

$$R_{crit} \approx \frac{\mu_0}{2\pi K} \tag{3}$$

This curvature is independent of the actual short circuit current and only depends on the proportionality factor K.

For a short circuit current I=50 kA and a gap distance of l=10 mm, a B-filed $B_{TMF}$=1.5 T and a force of $F_{TMF}$=750 N is chosen. Here a value of K=$B_{TMF}$/I=30 mT/kA.

For the parameters given above:

$$R_{crit}\approx 6.6\text{ mm} \tag{4}$$

This is of the order of the gap distance and means that unless the bending of the arc, to the outside is comparable to the driving force, we do not expect that the kink force will dominate the arc behavior. However, once the arc is established at the contacts edges, the curvature becomes more significant and the kink instability amplifies the arc bending to transform it finally to arc jets.

One could also reduce relatively the effect of the kink-instability forces by increasing the proportionality factor K=$B_{TMF}$/l which is geometry dependent.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SIGNS

1 pole part
2 electrical contact

3 electrical connector
4 vacuum housing
5 jack shaft
6 electromagnetic actuator
7 flexible conductor
8 contact shaft
9 cup-shaped contact part
10 contact ring
11 rim section
12 flange section
13 first concave groove
14 second concave groove
15 third concave groove
16 inner contact part
X arc zone

What is claimed is:

1. A vacuum interrupter arrangement for a medium voltage circuit breaker comprising:

a vacuum housing that is cylindrically shaped within which a pair of electrical contacts can be coaxially arranged and concentrically surrounded by the vacuum housing, wherein the electrical contacts can be formed as a type of transverse magnetic field(TMF)-contact, each having a slotted cup-shaped contact part which is attached to a distal end of a contact shaft and which is covered by a contact ring disposed on a rim of the cup-shaped contact part, wherein each cup-shaped contact part is provided with a vertical inward bending towards the contact ring, wherein an outer diameter of a bottom section of the cup-shaped contact part is larger than an outer diameter of the rim of the cup-shaped contact part in order to alter a Lorentz force on a constricted columnar arc to a respective inward direction, and wherein the vertical inward bending on the cup-shaped contact part is provided with a flat flange section of the cup-shaped contact part which is inwardly bent.

2. The vacuum interrupter arrangement according to claim 1, wherein the contact ring has an outer diameter equal to a bottom area of the cup-shaped contact part.

3. The vacuum interrupter arrangement according to claim 1, wherein each electrical contact is shaped as a single cup-type TMF-contact.

4. The vacuum interrupter arrangement according to claim 1, wherein each electrical contact is shaped as a double-TMF contact system consisting of a discoid inner contact part and a surrounding outer cup-shaped contact part.

5. The vacuum interrupter arrangement according to claim 4, wherein the inner contact part is spiral slotted.

6. A medium voltage circuit-breaker comprising:

at least one vacuum interrupter arrangement as claimed in claim 5 for at least one pole part operated by an electromagnetic actuator.

7. The vacuum interrupter arrangement according to claim 1, wherein the vertical inward bending on the cup-shaped contact part is provided with a concave groove disposed in an inner wall of the flange section.

8. The vacuum interrupter arrangement according to claim 1, wherein the vertical inward bending on the cup-shaped contact part is provided with a concave groove disposed in an outer wall of the flange section in an area of the rim.

9. The vacuum interrupter arrangement according to claim 8, wherein an additional concave groove is disposed in an inner wall of the flange section in a bottom area of the cup-shaped contact part.

10. A vacuum interrupter arrangement for a medium voltage circuit breaker comprising:

a vacuum housing that is cylindrically shaped within which a pair of electrical contacts can be coaxially arranged and concentrically surrounded by the vacuum housing, wherein the electrical contacts can be formed as a type of transverse magnetic field(TMF)-contact, each having a slotted cup-shaped contact part which is attached to a distal end of a contact shaft and which is covered by a contact ring disposed on a rim of the cup-shaped contact part, wherein each cup-shaped contact part is provided with a vertical inward bending towards the contact ring, wherein an outer diameter of a bottom section of the cup-shaped contact part is larger than an outer diameter of the rim of the cup-shaped contact part in order to alter a Lorentz force on a constricted columnar arc to a respective inward direction, and wherein the vertical inward bending on the cup-shaped contact part is provided with a concave groove disposed in an inner wall of a flange section of the cup-shaped contact part.

11. The vacuum interrupter arrangement according to claim 10, wherein the flange section of the vertical inward bending on the cup-shaped contact part is flat and inwardly bent and is provided with a concave groove disposed in an outer wall of the flange section in an area of the rim.

12. The vacuum interrupter arrangement according to claim 11, wherein an additional concave groove is disposed in the inner wall of the flange section in a bottom area of the cup-shaped contact part.

13. A vacuum interrupter arrangement for a medium voltage circuit breaker comprising:

a vacuum housing that is cylindrically shaped within which a pair of electrical contacts can be coaxially arranged and concentrically surrounded by the vacuum housing, wherein the electrical contacts can be formed as a type of transverse magnetic field(TMF)-contact, each having a slotted cup-shaped contact part which is attached to a distal end of a contact shaft and which is covered by a contact ring disposed on a rim of the cup-shaped contact part, wherein each cup-shaped contact part is provided with a vertical inward bending towards the contact ring, wherein an outer diameter of a bottom section of the cup-shaped contact part is larger than an outer diameter of the rim of the cup-shaped contact part in order to alter a Lorentz force on a constricted columnar arc to a respective inward direction, and wherein the vertical inward bending on the cup-shaped contact part is provided with a concave groove disposed in an outer wall of a flange section of the cup-shaped contact part in an area of the rim.

14. The vacuum interrupter arrangement according to claim 13, wherein an additional concave groove is disposed in an inner wall of the flange section in a bottom area of the cup-shaped contact part.

* * * * *